US006811027B2

(12) United States Patent
Alexander

(10) Patent No.: US 6,811,027 B2
(45) Date of Patent: Nov. 2, 2004

(54) QUICK OPENING GARMENT PROTECTOR

(75) Inventor: Richard Alexander, Rydal, PA (US)

(73) Assignee: Blue Mountain Innovations, LLC, Paterson, NJ (US)

( * ) Notice: Subject to any disclaimer, the term of this patent is extended or adjusted under 35 U.S.C. 154(b) by 0 days.

(21) Appl. No.: 09/927,922

(22) Filed: Aug. 10, 2001

(65) Prior Publication Data

US 2003/0029747 A1 Feb. 13, 2003

(51) Int. Cl.[7] ..... B65D 85/18; B31B 27/14

(52) U.S. Cl. ..... 206/386; 206/278; 229/87.15; 383/200; 383/207; 493/186; 493/267

(58) Field of Search ..... 206/278, 286; 229/87.15, 313, 70.15; 383/208, 209, 200, 207; 493/186, 267

(56) References Cited

U.S. PATENT DOCUMENTS

| | | | | |
|---|---|---|---|---|
| 961,803 A | | 6/1910 | Sahlin | |
| 1,203,042 A | | 10/1916 | Parnass | |
| 1,452,644 A | | 4/1923 | Kennedy | |
| 1,503,460 A | | 7/1924 | Bremner | |
| 1,652,269 A | | 12/1927 | Bremner | |
| 1,666,434 A | * | 4/1928 | Wordingham | 206/286 |
| 1,706,041 A | | 3/1929 | Potdevin | |
| 1,869,313 A | | 7/1932 | Mackay | |
| 1,981,571 A | | 11/1934 | Sachs | |
| 2,143,646 A | | 1/1939 | Chapman | |
| 2,270,547 A | | 1/1942 | Nichols | |
| 2,315,909 A | | 4/1943 | Stephenson | |
| 2,817,432 A | * | 12/1957 | Grigsby | 206/286 |
| 2,839,183 A | | 6/1958 | LaRosa | |
| 2,874,827 A | | 2/1959 | Neely | |
| 3,256,976 A | * | 6/1966 | Greason | 206/278 |
| 3,286,831 A | * | 11/1966 | Giberstein | 383/209 X |
| 3,865,235 A | * | 2/1975 | Lavy et al. | 206/286 |
| 3,909,582 A | * | 9/1975 | Bowen | 383/209 X |
| 3,987,959 A | * | 10/1976 | Deards et al. | 383/10 |
| 4,777,054 A | | 10/1988 | Greenhouse | |
| 4,957,203 A | * | 9/1990 | Gilchrist, Jr. | 206/286 |
| 5,158,499 A | * | 10/1992 | Guckenberger | 383/209 X |

(List continued on next page.)

FOREIGN PATENT DOCUMENTS

| | | | | |
|---|---|---|---|---|
| DE | 4120324 A1 | * | 12/1992 | |
| DE | 4311841 | * | 10/1993 | 229/313 |
| EP | 1136379 A1 | * | 9/2001 | |
| GB | 2333281 A | * | 7/1999 | |
| JP | 4267750 | * | 9/1992 | 383/209 |

*Primary Examiner*—Sue A. Weaver
(74) *Attorney, Agent, or Firm*—Morgan & Finnegan, L.L.P.

(57) ABSTRACT

A polyethylene garment protector, extensively used by garment manufacturers to protect garments in transport to and from various facilities such as, factories, distribution centers, and retail establishments. The garment protector is also commonly used by garment pressers or cleaners for the delivery or storage of pressed or cleaned garments mounted on conventional garment hangers. Furthermore, the polyethylene garment protector can also be used to enclose other textiles or goods that may be stored, shipped and/or sold in hanging form. The polyethylene garment protector is provided with at least one zone of weakness on either the front side, back side or both sides of such garment protectors, along which the garment protector may be severed to facilitate its removal so that the enclosed garment is not wrinkled or mussed. Essentially, the zone of weakness provides tear lines upon which the envelope may be opened to facilitate separating the protector and the enclosed garment. The zone of weakness may include minute perforations, which can vary in size and shape. Furthermore, the material of which the garment protector is made may also be partially but not completely severed along the linear zone of weakness. Alternatively, the zone of weakness may comprise a strip of thinner and less resilient material than the adjacent material from which the envelope is made, which can be easily torn.

60 Claims, 5 Drawing Sheets

U.S. PATENT DOCUMENTS 5,380,094 A * 1/1995 Schmidt et al. ..... 383/209
5,443,161 A * 8/1995 Jonese ..... 206/278 X
5,497,884 A * 3/1996 Dematteis et al. ..... 383/209 X
5,655,653 A * 8/1997 Chester ..... 383/209 X
5,704,481 A 1/1998 Lutz
5,934,809 A * 8/1999 Marbler ..... 383/208
D422,903 S 4/2000 Lim
6,102,571 A * 8/2000 Moteki et al. ..... 383/208
6,126,317 A * 10/2000 Anderson et al. ..... 383/207
6,318,894 B1 * 11/2001 Derenthal ..... 383/204

* cited by examiner

QUICK OPENING GARMENT PROTECTOR

BACKGROUND OF THE INVENTION

Garment protectors which take the form of envelopes or bags are extensively used by garment manufacturers to protect garments in transport to and from various facilities, such as factories, distribution centers and retail establishments and are frequently used as packaging upon retail sale to a consumer. Furthermore, garment protectors are also commonly used by garment pressers or cleaners for the delivery and/or storage of pressed or cleaned garments mounted on conventional garment hangers. These garment protectors offer temporary protection of the enclosed garments against dust, dirt, vermin or other deleterious influences, both during the transport of the garment from one destination, such as the factory, cleaners, garment pressers or the retail establishment, to a second destination, such as a distribution center and the consumer's home, and also while hanging in a storage fixture, such as a wardrobe, armoire or closet.

Prior art garment protectors are made of a polyolefin, most frequently polyethylene, and are usually transparent to permit viewing of the contents within the garment protector. However, the garment protector may also be opaque, for example, to conceal its contents or to carry advertising copy. At present, the most commonly used form of a garment protector comprises an envelope or bag consisting of a single-ply transparent film which is fabricated by tubular extrusion and thus is seamless on either side, open at the bottom and partially sealed at the upper end. The upper end of the polyolefin tubular casing is partially sealed by an inclined seam in order to form an envelope or bag which hangs over and encloses the garments. The inclined seam is properly angled to ensure an adequately shaped shoulder area that will conform loosely to the shape of the enclosed garment or supporting hanger. The hook of the conventional garment hanger extends from the interior of the envelope through an opening at the apex between the inclined seams.

In use, as is well known to workers in the garment manufacturing/cleaning trade, the garment protector is placed over the suspended garment, and the suspension element (i.e., the stem or hook) of the garment hanger extends through the opening at the apex of the garment protector. The inclined seams at the shoulder-enclosing portion of the garment protector directly rest upon the garment if it is a shirt, jacket or an item with a sleeve. However, if slacks are suspended from the conventional garment hanger the inclined seams will rest upon the downwardly sloping portions of the garment hanger. In commercial applications, the protectors are supplied on rolls, with individual garment protectors removed from the roll at the times an individual protector is needed.

There are currently two methods practiced in the art to remove the garment from the protective envelope or bag, the first of which includes lifting the polyethylene garment bag over the suspended articles of clothing and over the garment hanger. The second method of removal includes the destruction of the polyethylene envelope by puncturing or tearing it open. As the polyethylene material of the garment bag is relatively pliable, it stretches with applied horizontal strain until the material fails. Once the protective garment bag fails (that is, once there is a small rip or a tear in the protective bag), the ability to create a larger opening is facilitated. The garments can then be removed via the larger opening, or the protective garment cover can be completely torn from the garment. In either case, the protective garment cover no longer has the ability to completely enclose the garments.

Current constructions of the common polyethylene protector bags have inherent disadvantages. The first method described above, which entails lifting the garment bag over the suspended articles of clothing and over the garment hanger, usually requires the removal of the hung garment from a rod or hanging device, since ample space is required to lift the protective envelope or bag. Additionally, if care is not taken, the metal hook of the hanger may tear the bag, thus lessening its possible reuse, or accidentally puncture the skin of the user. Furthermore, the pressure of the bag or envelope against the garment and the hanger, as the bag is being hoisted up, may cause wrinkling of the garment and may also damage the hanger. The second method described above includes severing or puncturing the polyethylene protective envelope in order to remove the garments within. However, the elasticity of the polyethylene material makes tearing open the garment protector difficult for most individuals. Because a certain amount of stress or strain is required to cause the material to fail, not every individual is apt to utilize this method to remove the garments from the protective bag. Moreover, in puncturing the protective envelope, the enclosed garments may be mussed or wrinkled.

Accordingly, there exists a need for a construction of a protector bag which facilitates separating the enclosed garment and the garment protector.

SUMMARY OF THE INVENTION

The invention features a garment protector, preferably composed of polyethylene, provided with zones of weakness to facilitate removal of the garment protector by tearing along the zones of weakness. The garment protector comprises an elongated envelope intended to be preferably disposed about a garment suspended upon a hanger. However, the subject invention can also be used to protect other products or textiles that may be stored, shipped or sold in hanging form, for example, comforters, sheets, or towels. The upper end of the envelope has an opening at the apex for the suspension element of the hanger. In one embodiment, the polyethylene garment protector has at least one vertical zone of weakness on either its front side or its back side, along which the envelope may be parted to facilitate the quick removal of the protector from the garment without mussing or wrinkling the enclosed garment.

In a further embodiment, the garment protector has a plurality of zones of weakness on both the front and back side of the envelope, along any of which the envelope may be parted to facilitate either the removal of the garment from the garment protector or the removal of the garment protector from the suspended garment. The zone of weakness includes, but is not limited to, at least one line of perforations or a strip of material which is less durable and resilient. Essentially, the zone of weakness provides tear lines along which the garment protector may be parted to facilitate separating the garment and the protector.

In a further embodiment of the present invention, at least one zone of weakness is positioned diagonally across the garment protector in order to facilitate separating the protector and the garment. In a preferred embodiment, two diagonal zones of weakness are positioned across the garment protector in an "X" configuration to enable the bag to be parted across said diagonal tear lines.

In yet a further embodiment of the present invention, the garment protector also includes a pair of inclined seams at the upper part of the envelope which seals the envelope and permits the envelope to conform loosely to the shape of the enclosed garment.

A further embodiment of the present invention includes a polythene garment protector with at least one zone of weakness which encloses folded items or items not suspended upon conventional hangers. The folded garments or textiles are placed within the protector and said protector is completely sealed. In order to remove the folded garment or textile from the sealed protector, a zone of weakness is provided to facilitate separating the protector and the enclosed garment or textile.

A further embodiment of the present invention includes manufacturing methods to create the zone of weakness during the fabrication of the garment protector.

The advantages of this invention, both as to its construction and mode of operation, will be readily appreciated as the same becomes better understood by reference to the following detailed description when considered in connection with the accompanying drawings.

DETAILED DESCRIPTION OF THE INVENTION

The perforated polythene garment protector satisfies the shortcomings of existing garment protectors by providing zones of weakness upon which the polythene bag or envelope may be severed to facilitate the removal of the enclosed garment without mussing or wrinkling the same, or to facilitate the removal of the garment protector from the suspended garment. The perforated polythene garment protector can also be used to enclose other textiles or goods that may be stored, shipped or sold in hanging form.

Figure 1:
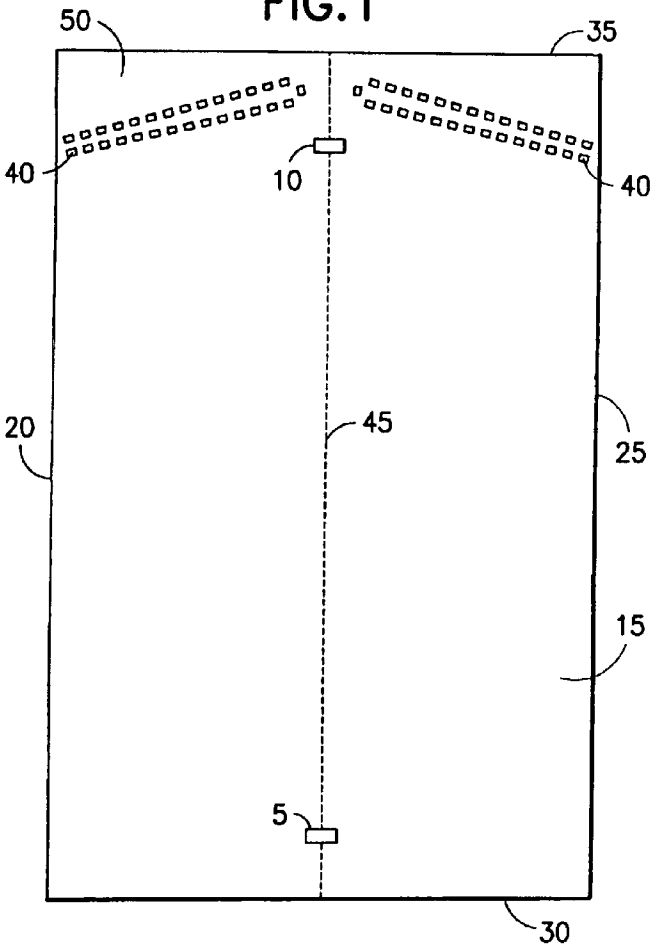
FIG. 1 illustrates a polythene garment protector provided with zones of weakness along the vertical axis of the protector according to one embodiment of the invention.

FIG. 1 is a perspective view of one embodiment of the improved garment protector (15), forming the subject matter hereof. Preferably, the garment protector (15) is made of a polythene, usually polyethylene, and is transparent in order to determine the contents of the garment protector. However, the garment protector of the present invention may also be opaque in order to conceal its contents. Furthermore, the garment protector may also be fabricated of paper, provided with zones of weakness as described herein. The subject garment protector (15), consists of a single-ply transparent film which is fabricated via a tubular extrusion (see step 801 of FIG. 8) and thus is seamless on either sides (20,25), open at the bottom (30) and partially sealed at the upper end (35). The upper end of the polyethylene tubular casing is sealed together by an inclined seam (40) in order to form an envelope or bag which hangs over and encloses the garments. The inclined seam (40) is properly angled to ensure an adequately shaped shoulder area that will conform loosely to the shape of the enclosed garment. In one embodiment of the present invention, the area above the inclined seam (50) is open at the top end (35). However, in a further embodiment, the top end (35) of the garment protector (15) may be completely sealed.

To facilitate the removal of the enclosed garment, the garment protector (15) contains a vertical zone of weakness (45), providing weakened tear lines upon which the envelope may be opened. In one embodiment of the invention, the vertical zones of weakness (45) are located on both sides of the garment protector. Various techniques which are known to those skilled in the art can be used to create a suitable and functional zone of weakness (45). In a preferred embodiment of the invention, the zone of weakness comprises minute perforations, which can vary in size and shape. The material of which the garment protector is made may also be partially but not completely severed along the linear zone of weakness. Alternatively, the zone of weakness (45) may comprise a strip of thinner and less resilient material than the adjacent material from which the envelope is made, which can be easily torn. Essentially, the zone of weakness (45) provides tear lines upon which the envelope may be opened to facilitate removal of the garment protector. Preferably the zone of weakness (45), depicted herein as a line of minute perforations (45), extends along the entire length of the bag. However, the length of the zone of weakness should be, but need not be, substantially along the entire length of the bag. For example, the zone of weakness (45) could span one-half or three-quarters of the length of the bag.

In a preferred embodiment, the zone of weakness (45) includes stops (5, 10), which are areas that are completely and fully intact and are not part of the zone of weakness. The stops (5, 10) protect the zone of weakness from inadvertently opening as the polyethylene garment protector (15) is placed over the garment (60), or as a garment enclosed in a polyethylene garment protector is removed from a support rod containing a plurality of suspended garments enclosed in polyethylene garment protectors.

Figure 2:
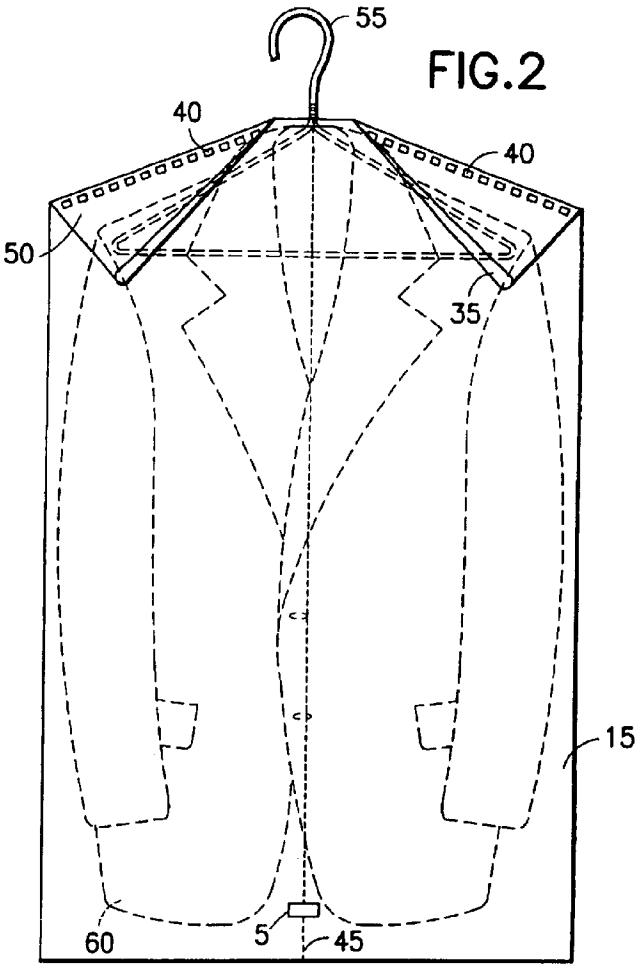
FIG. 2 depicts the garment protector of FIG. 1 with an enclosed garment suspended upon a conventional garment hanger.

FIG. 2 is an additional perspective view of the enhanced polyethylene garment protector (15) in which the enclosed garment (60) and the conventional garment hanger (55) are shown by dotted lines. The hook of the conventional garment hanger (55) extends from the interior of the envelope, through the apex and between the inclined seams (40). In FIG. 2, the zone of weakness is depicted as a perforated line (45). The perforations are made small enough so as not to permit the entrance of moths or their larvae. In a preferred embodiment of the invention, the vertical perforated line

(45) is located in the center of the polyethylene garment protector (15) and extends from the top edge to the bottom edge of the envelope (15). Furthermore, FIG. 2 illustrates the area above the inclined seams (50), as open at the top end (35).

Figure 3:
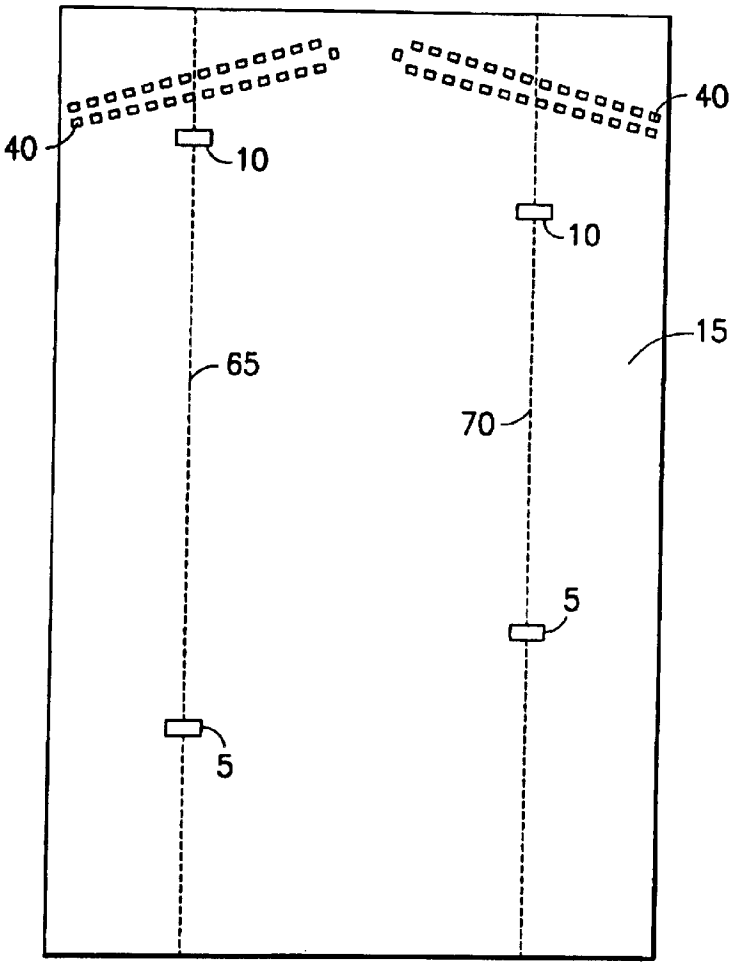
FIG. 3 illustrates a polythene perforated garment protector according to a second embodiment of the preferred invention which includes multiple perforated zones of weakness along the long axis of the protector.

In a further embodiment of the present invention, a plurality of zones of weakness are provided on the polyethylene garment protector. FIG. 3 illustrates the polyethylene garment protector (15) with two vertical and parallel zones of weakness (65, 70). The zone of weakness on the left side (65) is illustrated as minute perforations, and the zone of weakness on the right side (70) is illustrated as a strip of material which is less resistant to tearing than the adjacent material from which the envelope is made. Indeed, as illustrated in FIG. 3, multiple types of zones of weakness may exist on one garment protector. In addition, the zone of weakness on the right side (70) extends partially along the length of the garment protector, thus illustrating that the zones of weakness need not span the entire length of the garment protector. While FIG. 3 depicts only two zones of weakness (65, 70) on one side of the garment protector, it shall be understood that the polyethylene garment protector (15) may have one or more zones of weakness either on one side or on both sides of the polyethylene garment protector (15). In a preferred embodiment of the invention, the zones of weakness exist on both sides of the polyethylene garment protector (15) in exactly the same location; that is, both sides of the garment protector are mirror images of one another.

Figure 4:
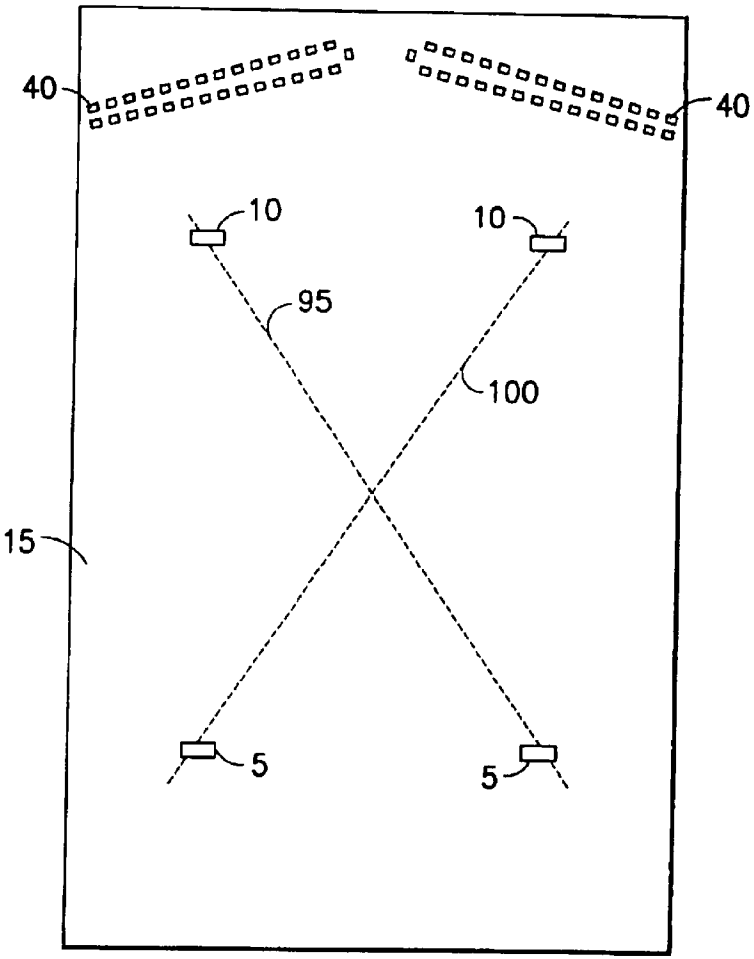
FIG. 4 illustrates a polythene perforated garment protector according to a further embodiment of the invention which includes diagonal perforated zones of weakness centered across the garment protector to form an "X" configuration.

In yet a further embodiment of the present invention, there exists at least one diagonal zone of weakness. FIG. 4 illustrates the subject polyethylene garment protector (15) with two diagonal zones of weakness (95, 100), intersecting across the center of the garment protector in an "X" configuration to provide tear lines upon which the garment protector may be parted to facilitate separating the enclosed garment and the protector. The zones of weakness are illustrated as extending substantially across the entire diagonal length of the garment protector. However, it shall be understood that the diagonal zones of weakness (95, 100) may extend along any proposed length of the diagonals of the garment protector (15). While FIG. 4 depicts only two diagonal zones of weakness intersected in an "X" configuration, it shall be understood that the polythene garment protector (15) may have multiple diagonal zones of weakness positioned in various configurations. Additionally, the garment protector (15) of the present invention may have multiple zones of weakness which can be oriented both vertically and diagonally across the garment protector to facilitate separating the enclosed garment and the protector. Furthermore, in yet another embodiment of the present invention, the zones of weakness may also be horizontal.

Figure 6:
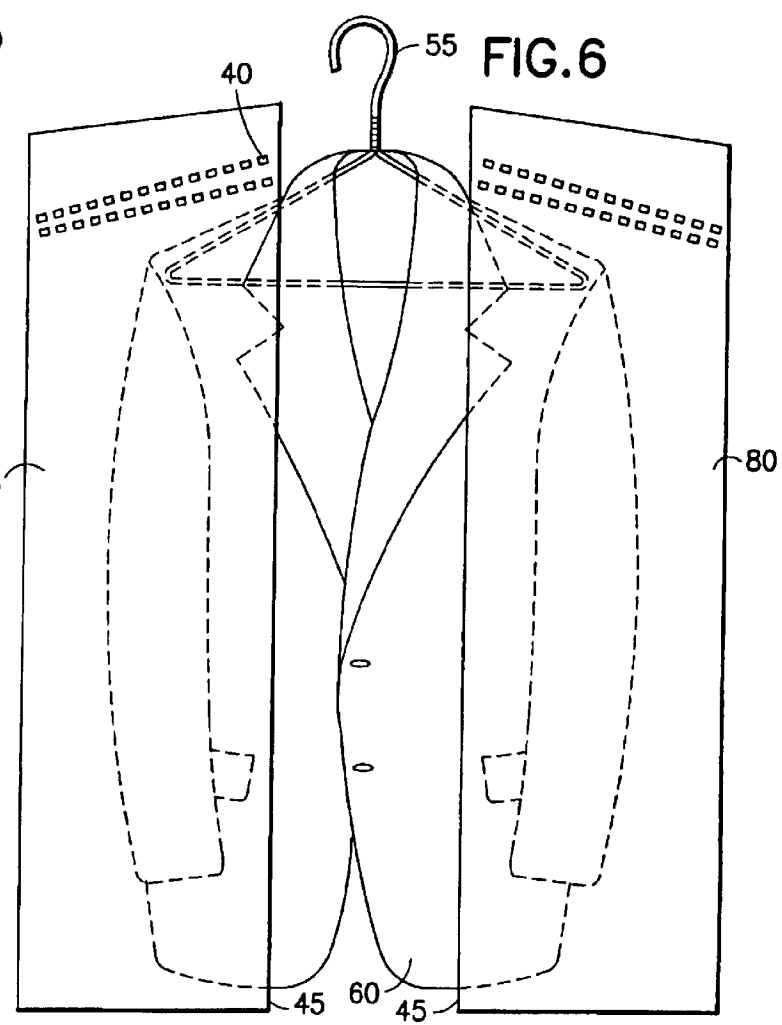
FIG. 6 depicts a second method of removing the polythene garment protector according to a second embodiment of the present invention, which inlcudes allowing the material of the garment protector to part along perforated tear lines located on both sides of the garment protector.
Figure 5:
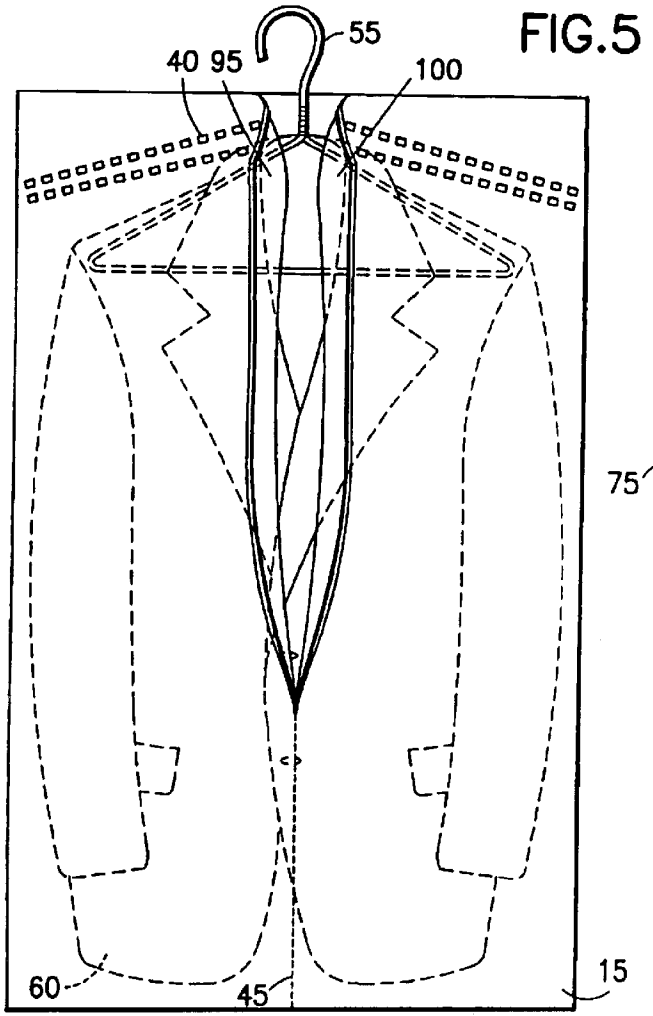
FIG. 5 illustrates a method of removing the polythene garment protector according to one embodiment of the present invention, which includes tearing open only one side of the garment bag.

FIGS. 5 and 6 illustrate exemplary methods for removing the garment from the polyethylene garment protector (15) or for removing the polyethylene garment protector from the suspended garment. In one embodiment, the garment is removed by applying stress along the zone of weakness at the top of the polyethylene garment protector (15), thus allowing the material to fail along the tear line (45) so as to open the bag as illustrated in FIG. 5. Stress is continuously applied along the length of the tear line (45) until the bag is completely severed from top to bottom on one side of the polyethylene garment protector (15). Hence, the polyethylene garment protector (15) may be removed without disturbing the garment and, for that matter, without necessitating the removal of the suspended garment from a rod upon which it may be hanging. While FIG. 5 depicts the aperture initiating at the top edge of the garment protector (15), it is to be understood that the initial stress can be applied at any point along the zone of weakness (45) to create an opening. The polyethylene garment protector may be easily removed by forcing a finger through the perforated line (45) at any point along the length of the garment protector or gripping the material on either side of the perforated line (45) and pulling laterally and outwardly in a direction perpendicular to the perforated line (45), thereby severing the polyethylene garment protector from top to bottom. FIG. 5 illustrates severing the polyethylene garment protector (15) on one side only, although both sides of the polyethylene garment protector may have zones of weakness. However, in a preferred embodiment, the polyethylene garment protector is severed on both the front and back sides.

In FIG. 5, the envelope is parted by initially applying stress along the zone of weakness (45) at the top of the envelope, thereby exposing the enclosed garment (15) in this "peel-away" configuration, as the resulting two flaps (95, 100) of the garment protector are continuously pulled further apart.

FIG. 6 illustrates an alternative embodiment of removing the polythene garment protector (15) from the suspended garments (60), in which both the front and back perforated lines are severed, essentially splitting the polyethylene garment protector (15) into two separate sections (75, 80). Therefore, each section easily slips off of the suspended garment without disturbing the garment and without having to remove the garment from the rod where it may be suspended. Although FIG. 5 illustrates the polyethylene garment protector (15) as completely severed, it is to be understood that the garment protector (15) may be removed from the suspended garment when the garment protector is only partially severed.

Figure 8:
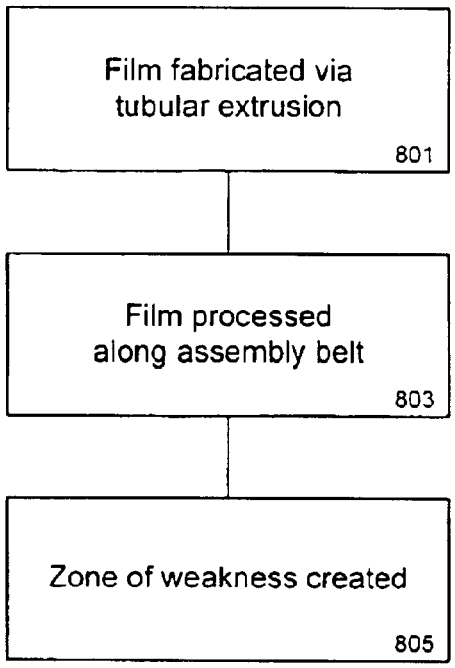
FIG. 8 is a diagram showing exemplary steps involved in fabricating a garment protector according to embodiments of the present invention.

With respect to FIG. 8 it is noted that there are numerous manufacturing methods apparent to those skilled in the art, to create zones of weakness during the fabrication of the polythene garment protector. In one embodiment, a perforated score line is created by a wheel which passes down the center of the garment protector (15) (step 805) as the polythene film is processed along an assembly belt (step 803). In a further embodiment, a perforated score line or another zone of weakness may be created by a laser emitting its energy in the form of an electro-optic beam (step 805). In yet a further embodiment, a strip of less durable and/or less resilient material is used in the zone of weakness during fabrication of the polyethylene garment protector. The methods described herein are only exemplary and it is to be understood that various manufacturing methods known by those skilled in the art can be employed to create various zones of weakness upon which the garment protector may be easily and quickly torn to facilitate its removal.

Figure 7:
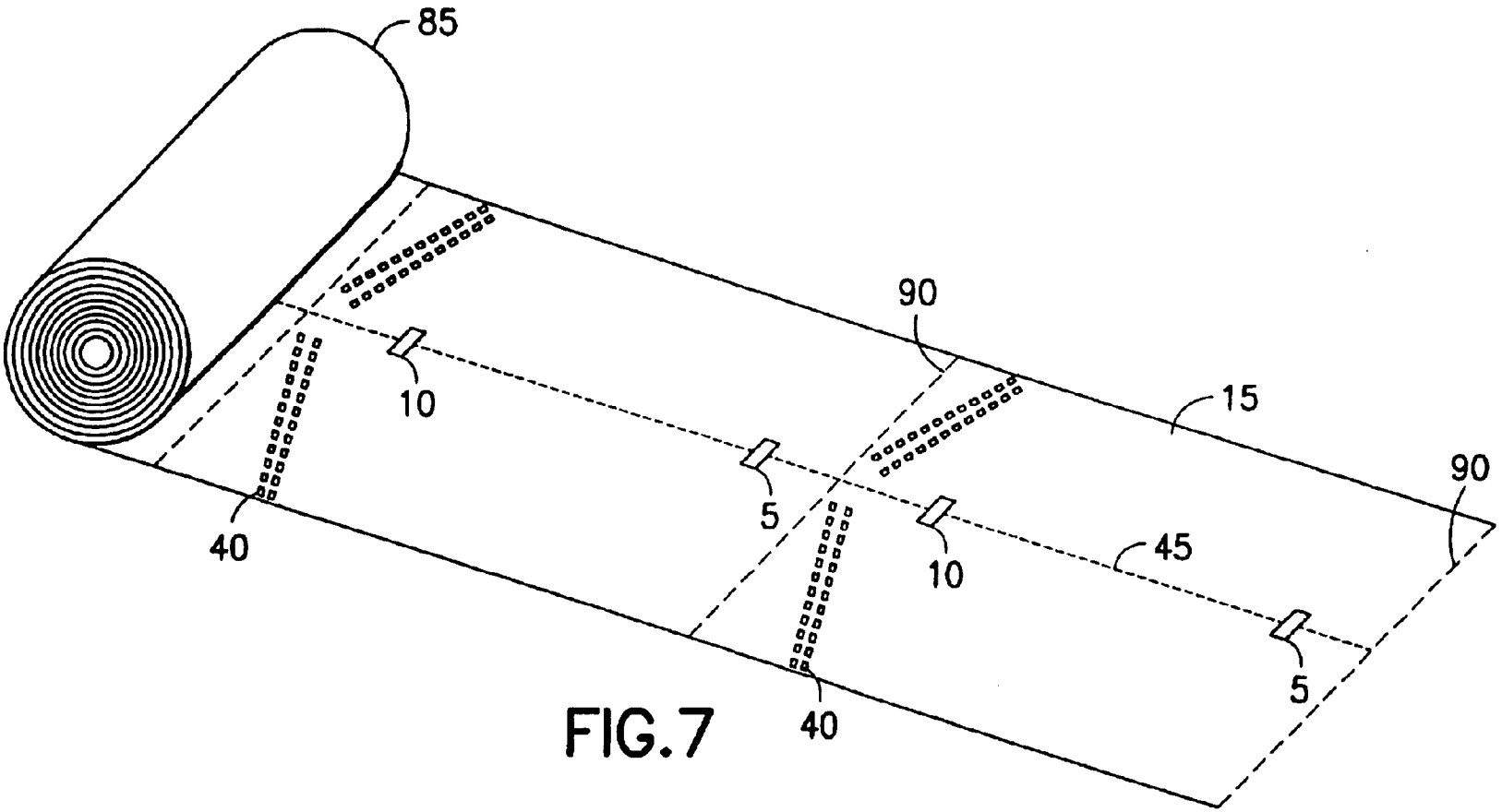
FIG. 7 illustrates a preferred method of packaging and shipping the manufactured polythene garment protector with its at least one zone of weakness and with a transverse zone of weakness to enable severing each bag from the roll.

In one embodiment of the invention, the polyethylene garment protector is fabricated and packaged into a continuous roll (85) as depicted in FIG. 7. The roll is comprised of a plurality of garment protectors which are separated by transverse perforated seams (90). The polyethylene garment protectors are separated from one another by sharply pulling at the perforated seam (90).

A further embodiment of the present invention includes a polythene garment protector with at least one zone of weakness which encloses folded items or items not suspended upon a conventional hanger. The folded garments or textiles are placed within the protector and said protector is completely sealed. In order to remove the folded garment or textile from the sealed protector a zone of weakness is provided to facilitate separating the protector and the enclosed garment or textile.

It is to be understood that the embodiments and variations shown and described herein are merely illustrative of the principles of the present invention. Therefore, various adaptations and modifications of its form, proportions, detail construction and arrangement of parts may be implemented by those skilled in the art without departing from the spirit and scope of the present invention.

What is claimed is:

1. A garment protector comprising:

an elongated envelope to be disposed about a garment, said envelope having a front side and a back side, at least one zone of weakness on either one or both sides along which said envelope may be parted to facilitate separating the garment protector from the garment, and at least one stop on the zone of weakness which protects the zone of weakness from inadvertently parting, wherein said stops are defined by areas of said envelope that are intact and interrupt the zone of weakness.

2. The garment protector of claim 1, wherein the garment protector is fabricated from polythene.

3. The garment protector of claim 1, wherein the garment protector is fabricated from polyethylene.

4. The garment protector of claim 1, wherein the garment protector is fabricated from paper.

5. The garment protector of claim 1, wherein the zone of weakness is a perforated line.

6. The garment protector of claim 1, wherein the zone of weakness comprises a strip of material which is less resistant to tearing than the adjacent material form which the garment protector is made.

7. The garment protector of claim 1, wherein the garment protector is transparent.

8. The garment protector of claim 1, wherein the garment protector is translucent.

9. The garment protector of claim 1, wherein the garment protector is opaque.

10. The garment protector of claim 1, comprising a pair of inclined seams at the upper part of the envelope which substantially seals the envelope and permits the envelope to conform loosely to a shape of the enclosed garment.

11. A garment protector comprising:

an elongated envelope to be disposed about a garment, at least one vertical zone of weakness extending substantially along the entire vertical length of the envelope along which said envelope may be parted to facilitate separating the garment protector from the garment, and at least one stop on the vertical zone of weakness which protects the zone of weakness from inadvertently partings, wherein said stops are defined by areas of said envelope that are intact and interrupt the zone of weakness.

12. The garment protector of claim 11, wherein the garment protector is fabricated from polythene.

13. The garment protector of claim 11, wherein the zone of weakness is a perforated line.

14. The garment protector of claim 11, wherein the zone of weakness comprises a strip of material which is less resistant to tearing than the adjacent material form which the garment protector is made.

15. The garment protector of claim 11, wherein the garment protector is transparent.

16. The garment protector of claim 11, comprising a pair of inclined seams at the upper part of the envelope which substantially seals the envelope and permits the envelope to conform loosely to a shape of the enclosed garment.

17. A garment protector comprising:

an elongated envelope to be disposed about a garment suspended upon a hanger, the upper end of said envelope having an opening at the apex for a suspension element of said hanger, wherein said envelope has a front side and a back side, at least one vertical zone of weakness on either the front side or back side along which said envelope may be parted to facilitate separating the garment protector from the garment, and at least one stop on the vertical zone of weakness which protects the zone of weakness from inadvertently parting, wherein said stops are defined by areas of said envelope that are intact and interrupt the zone of weakness.

18. The garment protector of claim 17, wherein the garment protector is fabricated from polythene.

19. The garment protector of claim 17, wherein the zone of weakness is a perforated line.

20. The garment protector of claim 17, wherein the zone of weakness comprises a strip of material which is less resistant to tearing than the adjacent material form which the garment protector is made.

21. The garment protector of claim 17, wherein the garment protector is transparent.

22. The garment protector of claim 17, comprising a pair of inclined seams at the upper part of the envelope which substantially seals the envelope and permits the envelope to conform loosely to a shape of the enclosed garment.

23. A garment protector comprising:

an elongated envelope to be disposed about a garment suspended upon a hanger, the upper end of said envelope having an opening at the apex for a suspension element of said hanger, wherein said envelope has a front side and a back side, at least one vertical zone of weakness on both the front side and back side along which said envelope may be parted to facilitate separating the garment protector from the garment, and at least one stop on the vertical zone of weakness which protects the zone of weakness from inadvertently parting, wherein said stops are defined by areas of said envelope that are intact and interrupt the zone of weakness.

24. The garment protector of claim 23, wherein the garment protector is fabricated from polythene.

25. The garment protector of claim 23, wherein the zone of weakness is a perforated line.

26. The garment protector of claim 23, wherein the zone of weakness comprises a strip of material which is less resistant to tearing than the adjacent material form which the garment protector is made.

27. The garment protector of claim 23, wherein the garment protector is transparent.

28. The garment protector of claim 23, comprising a pair of inclined seams at the upper part of the envelope which substantially seals the envelope and permits the envelope to conform loosely to a shape of the enclosed garment.

29. A garment protector comprising:

an elongated envelope to be disposed about a garment suspended upon a hanger, the upper end of said envelope having an opening at the apex for a suspension element of said hanger, wherein said envelope has a front side and a back side, at least one diagonal zone of weakness on both the front side and back side along which said envelope may be parted to facilitate separating the garment protector from the garment, and at least one stop on the diagonal zone of weakness which protects the zone of weakness from inadvertently parting, wherein said stops are defined by areas of said envelope that are intact and interrupt the zone of weakness.

30. The garment protector of claim 29, wherein the garment protector is fabricated from polythene.

31. The garment protector of claim 23, wherein the zone of weakness is a perforated line.

32. The garment protector of claim 29, wherein the zone of weakness comprises a strip of material which is less resistant to tearing than the adjacent material form which the garment protector is made.

33. The garment protector of claim 29, wherein the garment protector is transparent.

34. The garment protector of claim 29, comprising a pair of inclined seams at the upper part of the envelope which substantially seals the envelope and permits the envelope to conform loosely to a shape of the enclosed garment.

35. A garment protector comprising:

an elongated envelope to be disposed about a garment suspended upon a hanger, the upper end of said envelope having an opening at the apex for a suspension element of said hanger, wherein said envelope has a front side and a back side, at least one vertical zone of weakness, extending substantially along the entire vertical length of said envelope, on both the front side and back side along which said envelope may be parted to facilitate separating the garment protector from the garment, wherein said at least one zone of weakness is a perforated line, and at least one stop on the vertical zone of weakness which protects the zone of weakness from inadvertently parting, wherein said stops are defined by areas of said envelope that are intact and interrupt the zone of weakness.

36. The garment protector of claim 35, wherein the garment protector is fabricated from polythene.

37. The garment protector of claim 35, wherein the zone of weakness comprises a strip of material which is less resistant to tearing than the adjacent material form which the garment protector is made.

38. The garment protector of claim 35, wherein the garment protector is transparent.

39. The garment protector of claim 35, comprising a pair of inclined seams at the upper part of the envelope which substantially seals the envelope and permits the envelope to conform loosely to a shape of the enclosed garment.

40. A garment protector comprising:

an elongated envelope to be disposed about a garment suspended upon a hanger, the upper end of said envelope having an opening at the apex for a suspension element of said hanger, wherein said envelope has a front side and a back side, at least one vertical zone of weakness, extending substantially along the entire vertical length of said envelope, on both the front side and back side along which said envelope may be parted to facilitate separating the garment protector from the garment, wherein said at least one zone of weakness comprises a strip of material which is less resistant to tearing than adjacent material from which said envelope is made, and at least one stop on the vertical zone of weakness which protects the zone of weakness from inadvertently parting, wherein said stops are defined by areas of said envelope that are intact and interrupt the zone of weakness.

41. The garment protector of claim 40, wherein the garment protector is fabricated from polythene.

42. The garment protector of claim 40, wherein the zone of weakness is a perforated line.

43. The garment protector of claim 40, wherein the garment protector is transparent.

44. The garment protector of claim 40, comprising a pair of inclined seams at the upper part of the envelope which substantially seals the envelope and permits the envelope to conform loosely to a shape of the enclosed garment.

45. A garment protector comprising:

an elongated envelope to be disposed about a garment said envelope having a front side and a back side, at least one vertical zone of weakness, extending substantially along the entire vertical length of said envelope, on both the front side and back side along which said envelope may be parted to facilitate separating the garment protector from the garment, and at least one stop on the vertical zone of weakness which protects the zone of weakness from inadvertently parting, wherein said stops are defined by areas of said envelope that are intact and interrupt the zone of weakness.

46. A garment protector comprising:

an elongated envelope composed of polythene to be disposed about a garment suspended upon a hanger, the upper end of said envelope having an opening at the apex for a suspension element of said hanger, wherein said envelope has a front side and a back side, a pair of inclined seams at the upper part of said envelope which substantially seals said envelope and permits said envelope to conform loosely to a shape of the enclosed garment, at least one vertical zone of weakness on both the front side and back side along which said envelope may be parted to facilitate tearing the garment protector entirely away from the garment, wherein the at least one vertical zone of weakness is a perforated line, and at least one stop on the vertical zone of weakness which protects the zone of weakness from inadvertently openings, wherein said stops are defined by areas of said envelope that are intact and interrupt the zone of weakness.

47. A garment protector comprising:

an elongated envelope composed of polythene to be disposed about a garment suspended upon a hanger, the upper end of said envelope having an opening at the apex for a suspension element of said hanger, wherein said envelope has a front side and a back side, a pair of inclined seams at the upper part of said envelope which substantially seals said envelope and permits said envelope to conform loosely to a shape of the enclosed garment, at least one diagonal zone of weakness on both the front side and back side along which said envelope may be parted to facilitate tearing the garment protector entirely away from the garment, wherein the at least one diagonal zone of weakness is a perforated line, and at least one stop on the diagonal zone of weakness which protects the zone of weakness from inadvertently opening, wherein said stops are defined by areas of said envelope that are intact and interrupt the zone of weakness.

48. A garment protector comprising:

a sealed envelope to enclose a folded garment or textile, said envelope having a front side and a back side, at least one zone of weakness on either one or both sides along which said sealed envelope may be parted to facilitate separating the garment protector from the enclosed garment or textile, and at least one stop on the zone of weakness which protects the zone of weakness from inadvertently parting, wherein said stops are defined by areas of said envelope that are intact and interrupt the zone of weakness.

49. A method of fabricating a garment protector, comprising:

forming by tubular extrusion an elongated envelope to be disposed about a garment, the envelope having a front side and a back side, generating at least one zone of weakness on either one or both sides extending along a length of the elongated envelope, and forming at least one stop on the zone of weakness which protects the zone of weakness from inadvertently parting, wherein said stops are defined by areas of said envelope that are intact and interrupt the zone of weakness.

50. The method of claim 49, wherein the at least one zone of weakness is generated utilizing a perforating wheel.

51. The method of claim 49, wherein the at least one zone of weakness is generated utilizing a laser.

52. The method of claim 50, wherein the at least one zone of weakness is generated by passing said wheel along the length of the envelope, as a film which the elongated envelope is comprised of is passed along an assembly belt.

53. A method of fabricating a garment protector, comprising:

forming by tubular extrusion an elongated envelope to be disposed about a garment suspended upon a hanger, forming an opening at the apex of the envelope for a suspension element of the hanger, forming a pair of inclined seams at the upper part of the envelope which substantially seal the envelope and permit the envelope to conform loosely to a shape of the enclosed garment, generating at least one vertical zone of weakness extending along a vertical length of the elongated envelope, and forming at least one stop on the vertical zone of weakness which protects the zone of weakness from inadvertently parting, wherein said stops are defined by areas of said envelope that are intact and interrupt the zone of weakness.

54. The method of claim 53, wherein the at least one vertical zone of weakness is generated utilizing a perforating wheel.

55. The method of claim 53, wherein the at least one vertical zone of weakness is generated utilizing a laser.

56. The method of claim 54, wherein the at least one vertical zone of weakness is generated by passing said wheel along the vertical length of the envelope, as a film which the elongated envelope is comprised of is passed along an assembly belt.

57. A method of fabricating a garment protector, comprising:

forming by tubular extrusion an elongated envelope to be disposed about a garment suspended upon a hanger, forming an opening at the apex of the envelope for a suspension element of the hanger, forming a pair of inclined seams at the upper part of the envelope which substantially seal the envelope and permit the envelope to conform loosely to a shape of the enclosed garment, generating at least one diagonal zone of weakness extending along a length of the elongated envelope, and forming at least one stop on the diagonal zone of weakness which protects the zone of weakness from inadvertently parting, wherein said stops are defined by areas of said envelope that are intact and interrupt the zone of weakness.

58. The method of claim 57, wherein the at least one diagonal zone of weakness is generated utilizing a perforating wheel.

59. The method of claim 57, wherein the at least one diagonal zone of weakness is generated utilizing a laser.

60. The method of claim 58, wherein the at least one diagonal zone of weakness is generated by passing said wheel along the diagonal length of the envelope, as a film which the elongated envelope is comprised of is passed along an assembly belt.

* * * * *